US009118992B2

(12) United States Patent
Satish et al.

(10) Patent No.: US 9,118,992 B2
(45) Date of Patent: Aug. 25, 2015

(54) PORTED ENCLOSURE AND AUTOMATED EQUALIZATION OF FREQUENCY RESPONSE IN A MICRO-SPEAKER AUDIO SYSTEM

(71) Applicant: NVIDIA CORPORATION, Santa Clara, CA (US)

(72) Inventors: Nikhil Satish, San Francisco, CA (US); David Dignam, Belmont, CA (US)

(73) Assignee: NVIDIA Corporation, Santa Clara, CA (US)

( * ) Notice: Subject to any disclaimer, the term of this patent is extended or adjusted under 35 U.S.C. 154(b) by 0 days.

(21) Appl. No.: 14/105,074

(22) Filed: Dec. 12, 2013

(65) Prior Publication Data

US 2014/0190763 A1 Jul. 10, 2014

Related U.S. Application Data

(60) Provisional application No. 61/749,853, filed on Jan. 7, 2013.

(51) Int. Cl.

| | |
|---|---|
| ***H04R 1/02*** | (2006.01) |
| ***H04R 3/04*** | (2006.01) |
| ***H04R 1/28*** | (2006.01) |

(52) U.S. Cl.

CPC ..... *H04R 3/04* (2013.01); *H04R 1/2888* (2013.01); *H04R 2499/11* (2013.01)

(58) Field of Classification Search

CPC ..... H04R 1/02
USPC ..... 181/199, 198
See application file for complete search history.

(56) References Cited

U.S. PATENT DOCUMENTS

| | | | | |
|---|---|---|---|---|
| 7,565,949 | B2 * | 7/2009 | Tojo | 181/199 |
| 8,675,903 | B2 * | 3/2014 | Ng et al. | 381/345 |
| 2007/0014424 | A1 * | 1/2007 | Eaton | 381/345 |
| 2009/0288911 | A1 * | 11/2009 | Chen et al. | 181/199 |
| 2013/0028434 | A1 * | 1/2013 | Sibbald et al. | 381/71.6 |
| 2013/0333975 | A1 * | 12/2013 | Dodd | 181/155 |

* cited by examiner

*Primary Examiner* — Forrest M Phillips
(74) *Attorney, Agent, or Firm* — Artegis Law Group, LLP

(57) ABSTRACT

One embodiment of the present invention sets forth a system that includes a detection device and a processor. The detection device is configured to sense that a handheld device has not been placed on or near a surface. In response to sensing that the handheld device has not been placed on or near a surface, the detection device is configured to transmit an indicator to the processor. The processor is configured to receive a first audio signal, and determine that the handheld device has not been placed on or near a surface by receiving the indicator from the detection device. In response to determining that the handheld device has not been placed on or near a surface, the processor is further configured to apply a compensating function to the first audio signal to generate a second audio signal, and transmit the second audio signal to a speaker.

20 Claims, 10 Drawing Sheets

PORTED ENCLOSURE AND AUTOMATED EQUALIZATION OF FREQUENCY RESPONSE IN A MICRO-SPEAKER AUDIO SYSTEM

CROSS-REFERENCE TO RELATED APPLICATIONS

This application claims the benefit of U.S. provisional patent application entitled "PORTED ENCLOSURE MICRO-SPEAKER AUDIO SYSTEM," Ser. No. 61/749,853, filed Jan. 7, 2013, which is hereby incorporated herein by reference.

BACKGROUND OF THE INVENTION

1. Field of the Invention

The present invention generally relates to audio systems and, more particularly, to a ported enclosure and automated equalization of frequency response in a micro-speaker audio system.

2. Description of the Related Art

Conventional loudspeakers are typically mounted within an enclosure where the enclosure blocks the rear-generated speaker sounds which are out of phase with the sounds being directed to the listener by the speaker. Mounting the loudspeakers within an enclosure prevents reduction of speaker volume output, as detected by the listener, caused by cancellation between the sounds emanating from the front and back sides of the loudspeaker cone.

The enclosure to which the loudspeaker is mounted acts as a baffle, where the dimensions of the baffle determine the range of frequencies at which the baffle is effective. A baffle appears to be of infinite size if the baffle limits the radiation pattern of the loudspeaker from 360 degrees to 180 degrees. Under these circumstances, someone standing behind the baffle hears essentially no sound, while someone standing in front of the baffle hears essentially twice the sound volume as compared to the sound output without this "infinite baffle" effect. Such an infinite baffle results in a 6 db, or 2×, boost in sound pressure as compared with a non-baffled loudspeaker. Generally, the baffle appears to be infinite, and thus effective, at frequencies whose wavelengths are no greater than approximately three times the shortest dimension of the baffle. For speakers mounted in mobile, or handheld, devices, the baffle size is typically determined by ergonomics and industrial design considerations.

The baffle appears to be finite, and thus ineffective, at frequencies whose wavelengths are greater than approximately three times the shortest dimension of the baffle. A finite baffle size poses a problem for handheld devices. If a handheld device is placed on a table, then the table acts as an infinite baffle even at fairly low frequencies. For example, if the shortest dimension of the table is 24 inches, then the table would act as an infinite baffle at all wavelengths up to 3×24 or 72 inches, corresponding to frequencies at or above approximately 187 Hz. However, if the shortest dimension of the handheld device is four inches and the device is being held in free-space, then the device would act as an infinite baffle only up to wavelengths of 3×4 or 12 inches, corresponding to frequencies at or above approximately 1125 Hz. In this example, the mobile device held in free air would have an output that is reduced by 6 db at frequencies below 1125 Hz; whereas, if the same device is placed on a table, then this 6 db reduction would occur only for frequencies below 187 Hz. In other words, if such a handheld device is being held in free-space, then the loudspeaker volume and performance of the handheld device would be reduced in the range of 187-1125 Hz as compared with the performance of the device when placed on a table. Effectively, sounds below 1125 Hz would appear to be dampened or suppressed as compared to sounds above 1125 Hz.

In addition, conventional loudspeakers are often placed within a ported enclosure, also known as a vented enclosure or bass reflex enclosure, which may reduce certain distortion effects as compared with such a speaker placed within a sealed enclosure. Such a ported enclosure may reduce the effective displacement of the loudspeaker, particularly when the loudspeaker is driven at loud volumes in the lower portion of the frequency range. Distortion occurs when the actual displacement of the loudspeaker exceeds the speakers rated maximum displacement limit. By reducing the effective displacement of the loudspeaker, the loudspeaker may be driven to higher volumes before the speaker starts producing distorted sound waves. Accordingly, a loudspeaker in a ported enclosure may be driven to louder volumes without low frequency distortion as compared to the same loudspeaker in a sealed enclosure, thus improving the low frequency output of the speaker enclosure.

As the foregoing illustrates, what is needed in the art is an improved approach for producing sound in a handheld device.

SUMMARY OF THE INVENTION

One embodiment of the present invention sets forth a system that includes a detection device and a processor. The detection device is configured to sense that a handheld device has not been placed on or near a surface. In response to sensing that the handheld device has not been placed on or near a surface, the detection device is configured to transmit an indicator to the processor. The processor is configured to receive a first audio signal. The processor is further configured to determine that the handheld device has not been placed on or near a surface by receiving the indicator from the detection device. In response to determining that the handheld device has not been placed on or near a surface, the processor is further configured to apply a compensating function to the first audio signal to generate a second audio signal, and transmit the second audio signal to a speaker. This compensating function boosts the low frequency signals by 6 db below the frequency at which the baffle the speakers are mounted on is effectively infinite.

Another embodiment of the present invention sets forth a ported enclosure configured to house a micro-speaker. The ported enclosure includes an enclosure comprising a port, where the enclosure is tuned to a first resonance frequency that is different from a second resonance frequency associated with the micro-speaker.

Other embodiments include, without limitation, a speaker module and a handheld device configured to implement one or more aspects of the present invention. Other embodiments include, without limitation, a method to implement one or more aspects of the disclosed methods and a computer-readable storage medium that includes instructions that enable a processing unit to implement one or more aspects of the present invention.

One advantage of the disclosed techniques is that a flat frequency response is produced by the handheld device whether the handheld device is being held in free-space or placed on a table. The perceived sound quality does not change regardless of whether the mobile device is hand held or placed on a table. Another advantage of the disclosed techniques is that micro-speakers in the handheld device produce relatively high volume signals at low frequencies with little or no distortion. As a result, the user of the handheld device experiences an improved audio experience across a variety of applications.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

In the following description, numerous specific details are set forth to provide a more thorough understanding of the present invention. However, it will be apparent to one of skill in the art that the present invention may be practiced without one or more of these specific details.

System Overview

Figure 1:
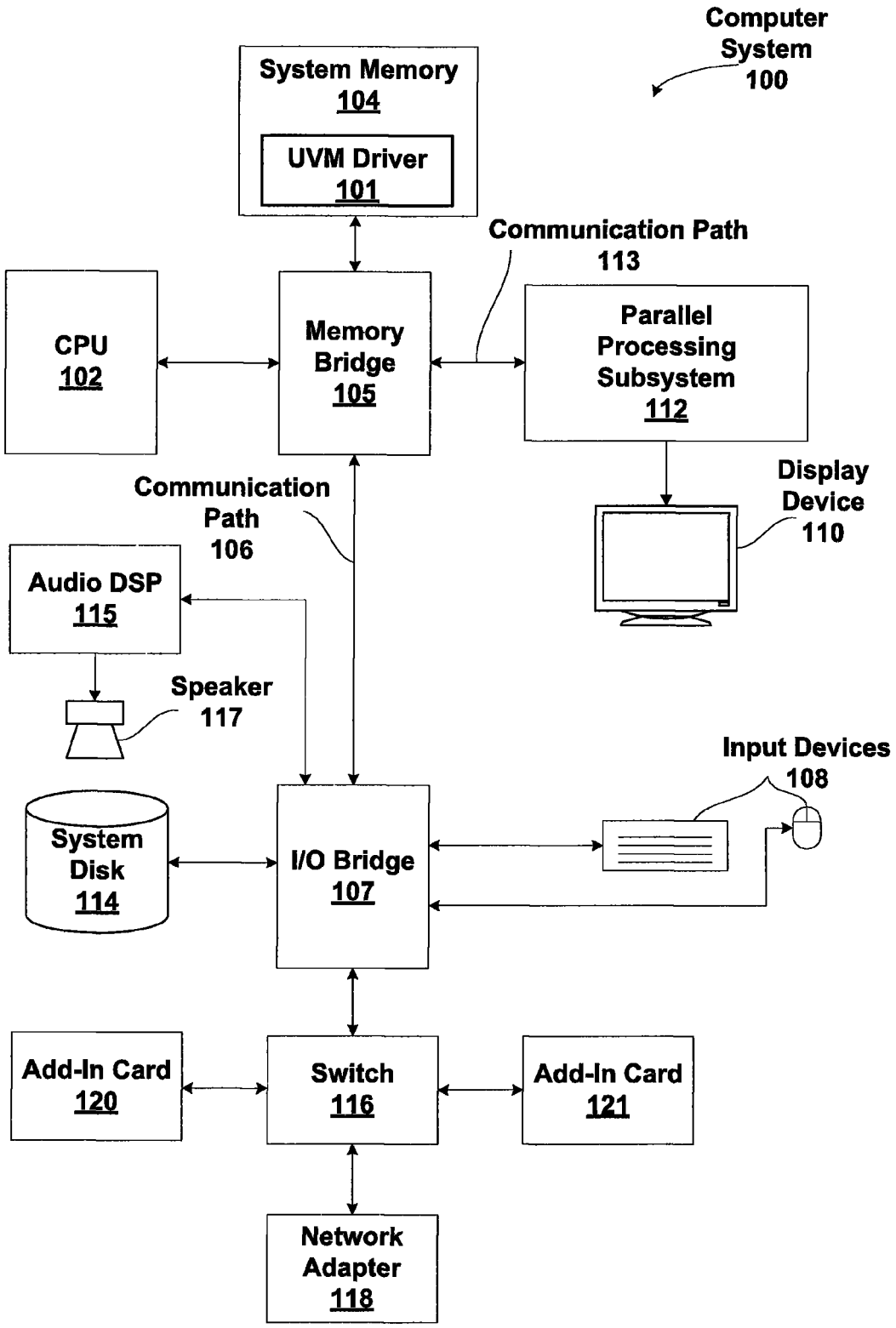
FIG. 1 is a block diagram illustrating a computer system configured to implement one or more aspects of the present invention.

FIG. 1 is a block diagram illustrating a computer system 100 configured to implement one or more aspects of the present invention. Computer system 100 includes a central processing unit (CPU) 102 and a system memory 104 communicating via an interconnection path that may include a memory bridge 105. Memory bridge 105, which may be, e.g., a Northbridge chip, is connected via a bus or other communication path 106 (e.g., a HyperTransport link) to an I/O (input/output) bridge 107. I/O bridge 107, which may be, e.g., a Southbridge chip, receives user input from one or more user input devices 108 (e.g., keyboard, mouse) and forwards the input to CPU 102 via communication path 106 and memory bridge 105. An audio digital signal processor (DSP) 115 is coupled to I/O bridge 107 via a bus to receive digital audio data and control from various applications, process the digital audio data, and convert the digital audio data to an analog signal. The audio DSP 115 may include various audio functions, including, without limitation, a multiband parametric equalizer, a mixer, and an audio effects generator. The audio DSP 115 transmits the analog signal to one or more speakers such as speaker 117. In some embodiments, the audio DSP 115 transmits the digital audio data or the analog signal to a connector (not shown) configured to deliver the digital audio data or the analog signal to an external device.

A parallel processing subsystem 112 is coupled to memory bridge 105 via a bus or second communication path 113 (e.g., a Peripheral Component Interconnect (PCI) Express, Accelerated Graphics Port, or HyperTransport link); in one embodiment parallel processing subsystem 112 is a graphics subsystem that delivers pixels to a display device 110 that may be any conventional cathode ray tube, liquid crystal display, light-emitting diode display, or the like. A system disk 114 is also connected to I/O bridge 107 and may be configured to store content and applications and data for use by CPU 102 and parallel processing subsystem 112. System disk 114 provides non-volatile storage for applications and data and may include fixed or removable hard disk drives, flash memory devices, and CD-ROM (compact disc read-only-memory), DVD-ROM (digital versatile disc-ROM), Blu-ray, HD-DVD (high definition DVD), or other magnetic, optical, or solid state storage devices.

A switch 116 provides connections between I/O bridge 107 and other components such as a network adapter 118 and various add-in cards 120 and 121. Other components (not explicitly shown), including universal serial bus (USB) or other port connections, compact disc (CD) drives, digital versatile disc (DVD) drives, film recording devices, and the like, may also be connected to I/O bridge 107. The various communication paths shown in FIG. 1, including the specifically named communication paths 106 and 113 may be implemented using any suitable protocols, such as PCI Express, AGP (Accelerated Graphics Port), HyperTransport, or any other bus or point-to-point communication protocol(s), and connections between different devices may use different protocols as is known in the art.

In one embodiment, the parallel processing subsystem 112 incorporates circuitry optimized for graphics and video processing, including, for example, video output circuitry, and constitutes a graphics processing unit (GPU). In another embodiment, the parallel processing subsystem 112 incorporates circuitry optimized for general purpose processing, while preserving the underlying computational architecture, described in greater detail herein. In yet another embodiment, the parallel processing subsystem 112 may be integrated with one or more other system elements in a single subsystem, such as joining the memory bridge 105, CPU 102, and I/O bridge 107 to form a system on chip (SoC).

It will be appreciated that the system shown herein is illustrative and that variations and modifications are possible. The connection topology, including the number and arrangement of bridges, the number of CPUs 102, and the number of parallel processing subsystems 112, may be modified as desired. For instance, in some embodiments, system memory 104 is connected to CPU 102 directly rather than through a bridge, and other devices communicate with system memory 104 via memory bridge 105 and CPU 102. In other alternative topologies, parallel processing subsystem 112 is connected to I/O bridge 107 or directly to CPU 102, rather than to memory bridge 105. In still other embodiments, I/O bridge 107 and memory bridge 105 might be integrated into a single chip instead of existing as one or more discrete devices. Large embodiments may include two or more CPUs 102 and two or more parallel processing subsystems 112. The particular components shown herein are optional; for instance, any number of add-in cards or peripheral devices might be supported. In some embodiments, switch 116 is eliminated, and network adapter 118 and add-in cards 120, 121 connect directly to I/O bridge 107.

If the computer system 100 is housed in a handheld device, then certain mechanical restrictions may reduce the sound quality produced by the speakers. First, the small overall size of the device may result in a 6 db (2×) volume difference between sounds at higher frequencies versus sounds at lower frequencies, rather than a flat frequency response across the audible spectrum, particularly when the handheld device is being held in free-space. However, the frequency response may be flat across the audible spectrum when the handheld device is placed on a large surface, such as a table. In addition, the small volume of the micro-speaker enclosure limits the amount of air that the micro-speaker can displace, which, in turn, limits the ability of the micro-speaker to produce low frequency sounds at high volume without distortion. The described techniques may be used to produce a flat frequency response whether the handheld device is being held in free-space or placed on a larger surface.

Frequency Response Adjustment Based on Baffle Size

Figure 2:
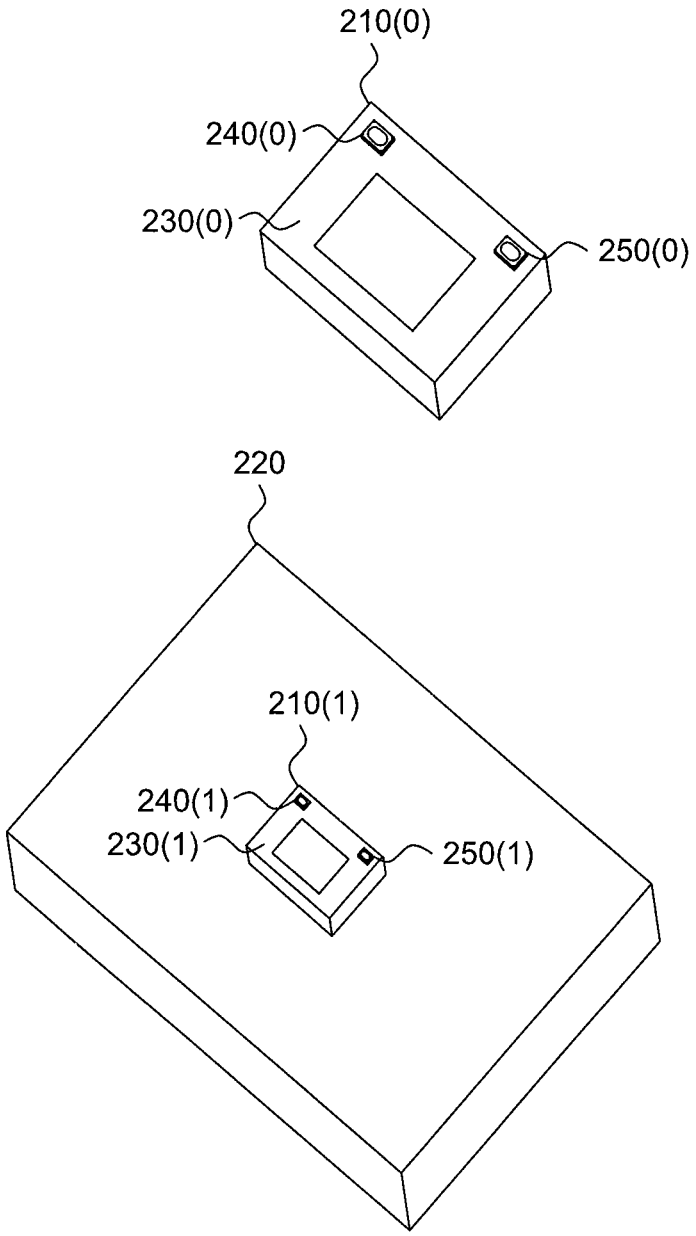
FIG. 2 illustrates a first handheld device residing in free-space and a second handheld device residing on a surface, according to one embodiment of the present invention.

FIG. 2 illustrates a first handheld device 210(0) residing in free-space and a second handheld device 210(1) residing on a surface 220, according to one embodiment of the present invention. As shown, each handheld device 210 includes a housing 230, a left micro-speaker 240, and a right micro-speaker 250. Each handheld device may include a computer system such as the computer system 100 with the audio DSP 115. The audio DSP 115 may be configured to drive the left micro-speaker 240, and the right micro-speaker 250. The handheld devices may be any technically feasible handheld devices, including, without limitation, cell phones, tablets, and other mobile devices.

The first handheld device 210(0) produces sound from the left micro-speaker 240(0) and the right micro-speaker 250(0), typically in association with an application executing on the computer system 100 within the first handheld device 210(0). The housing 230(0) acts as a baffle for both the left micro-speaker 240(0) and the right micro-speaker 250(0), where a baffle is a surface behind the micro-speaker configured to block out-of-phase, rearward-generated sounds and to reflect sound waves forward. The shorter dimension of the housing 230(0) determines the critical frequency, above which the housing 230(0) behaves as an infinite baffle. Generally, the critical frequency corresponds to a signal with a wavelength that is approximately three times the shorter dimension of the housing 230(0).

For example, if the shorter dimension of the housing 230(0) is four inches, then the critical frequency would correspond to a signal with a wavelength of twelve inches. The critical frequency could be calculated by the equation $f_c=s/w$, where $f_c$ is the critical frequency, w is the wavelength, and s is the speed of sound in free air. If the speed of sound is 1126 feet/second, then a wavelength of twelve inches would correspond to a critical frequency of approximately 1,126 Hz. Sounds produced by the left micro-speaker 240(0) and the right micro-speaker 250(0) that are above the critical frequency experience a 6 dB boost in audio level as compared with sounds produced that are below the critical frequency. To produce a flat frequency response, the audio DSP 115 could apply a compensating function that boosts the audio signal to the left micro-speaker 240(0) and the right micro-speaker 250(0) for frequencies that are below the critical frequency. Accordingly, the DSP applies a 6 dB boost to audio signals below the critical frequency, while the housing, acting as a baffle, applies a 6 dB boost to audio signals above the critical frequency. As a result, the user of the first handheld device 210(0) perceives a flat frequency response across the audible range.

The second handheld device 210(1) produces sound from the left micro-speaker 240(1) and the right micro-speaker 250(1), also typically in association with an application executing on the computer system 100 within the second handheld device 210(1). However, because the second handheld device 210(1) is placed on the surface 220, the surface 220, rather than the housing 230(1), acts as a baffle for both the left micro-speaker 240(1) and the right micro-speaker 250(1). Again, the shorter dimension of the surface 220 determines the critical frequency, above which the surface 220 behaves as an infinite baffle.

For example, if the shorter dimension of the surface 220 is three feet, then the critical frequency would correspond to a signal with a wavelength of nine feet. The critical frequency corresponding to a wavelength of nine feet would be approximately 125 Hz. The critical frequency of 125 Hz could be near the lower cutoff frequency of the left micro-speaker 240(1) and the right micro-speaker 250(1), where the lower cutoff frequency is the frequency below which a speaker produces no output. Accordingly, the audio DSP 115 would not apply a compensating function to the audio signal before transmitting the audio signal to the left micro-speaker 240(1) and the right micro-speaker 250(1). The user would perceive a flat frequency response down to the critical frequency of 125 Hz.

Each of the handheld devices 210 also includes a sensing device (not shown) configured to transmit a signal that identifies whether the given handheld device 210 is in free-space or place on or near a surface 210. In response to this signal, the audio DSP 115 applies a compensating function to the audio signal if the handheld device 210 is being held in free-space, where the compensating function boosts the audio signal below a critical frequency corresponding to a dimension of the housing 230. The audio DSP 115 does not apply the compensating function to the audio signal if the handheld device 210 is placed on or near a surface such as the surface 220.

The sensing device may employ any technically feasible approach for determining whether the associated handheld device 210 has been placed on or near a surface. In one example, the sensing device could include an on-board gyroscopic sensor or accelerometer. Such an on-board gyroscope or accelerometer could detect a change of orientation or location, such as a physical translation or rotation of the handheld device 210. If the sensing device detects a level orientation or a lack of movement for a period of time, then the sensing device could determine that the handheld device 210 is placed on or near a surface. If the sensing device detects a non-level orientation or a change in rotation or position, then the sensing device could determine that the handheld device 210 is being held in free-space. In another example, the sensing device could detect only a level or non-level orientation with detecting translation or lateral movement of the handheld device 210. In another example, the sensing device could prompt a user, such as via a selectable function in a graphical user interface, to select whether the handheld device 210 is placed on or near a surface or held in free-space.

In yet another example, a sensing device could acoustically detect whether the handheld device has been placed on or near a surface. An on-board microphone would detect a change in the acoustic gain associated with frequencies below the critical frequency associated with the handheld device 210 in free-space. If the sensing device detects an acoustic level below the critical frequency that corresponds to the handheld device 210 in free-space, then the sensing device would determine that the handheld device 210 is being held in free-space. If, however, the sensing device detects a boosted acoustic level below the critical frequency that corresponds to the handheld device 210 placed on a large baffle, then the sensing device would determine that the handheld device 210 is placed on or near a surface. The audio DSP 115 within the handheld device 210 could periodically transmit a test signal. The audio DSP 115 would then measure the acoustic level of the returned signal at that frequency via the on-board microphone. If the acoustic level of the returned signal is measurably higher at frequencies above the critical frequency, as compared with frequencies below the critical frequency, then the DSP may apply the compensating function to the audio signal transmitted to the micro-speaker. Otherwise, the DSP may not apply the compensating function to the audio signal transmitted to the micro-speaker. In the particular case of rear facing speakers and microphones, such an approach may readily detect increases in the acoustic level of signals at various frequencies when the handheld device is placed on or near a surface, such as a table.

Alternatively, the audio DSP 115 could wait for the sound from an executing application to produce a particular frequency or frequencies rather than generating a test signal. The audio DSP 115 may then apply a compensating function to the audio signal transmitted to the micro-speaker based on the measured acoustic level of the returned signal at the particular frequency or frequencies.

The various approaches described above are intended to be exemplary in nature only. Other approaches for detecting whether the handheld device has been placed on or near a surface or is being in free-space may be employed within the scope of the present invention.

Figure 3A:
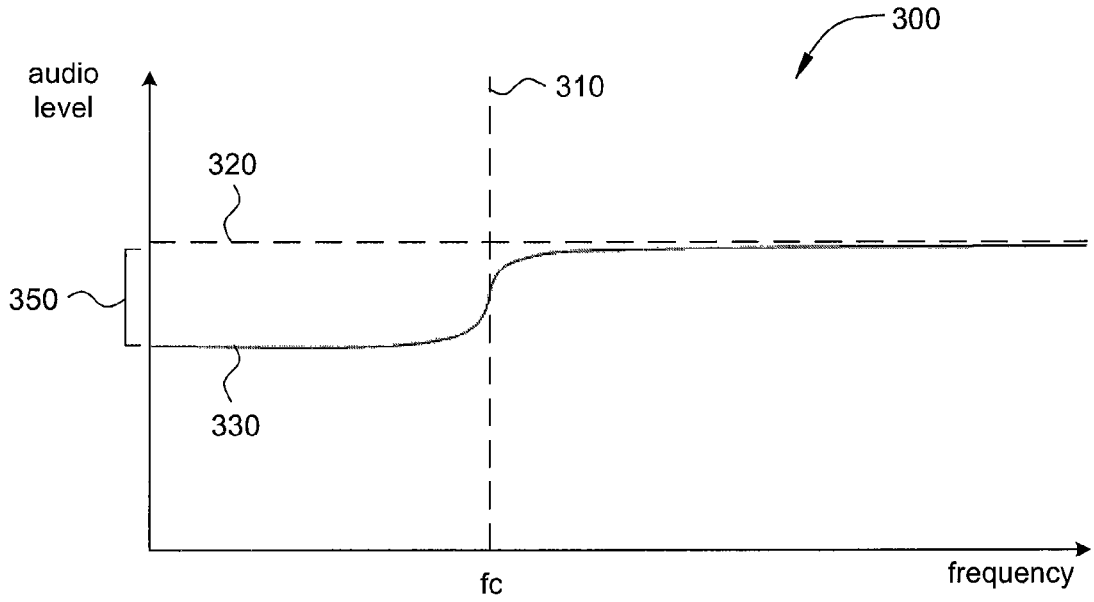
FIGS. 3A-3B are graphs of waveforms associated with the first handheld device and the second handheld device of FIG. 2, according to one embodiment of the present invention.
Figure 3B:
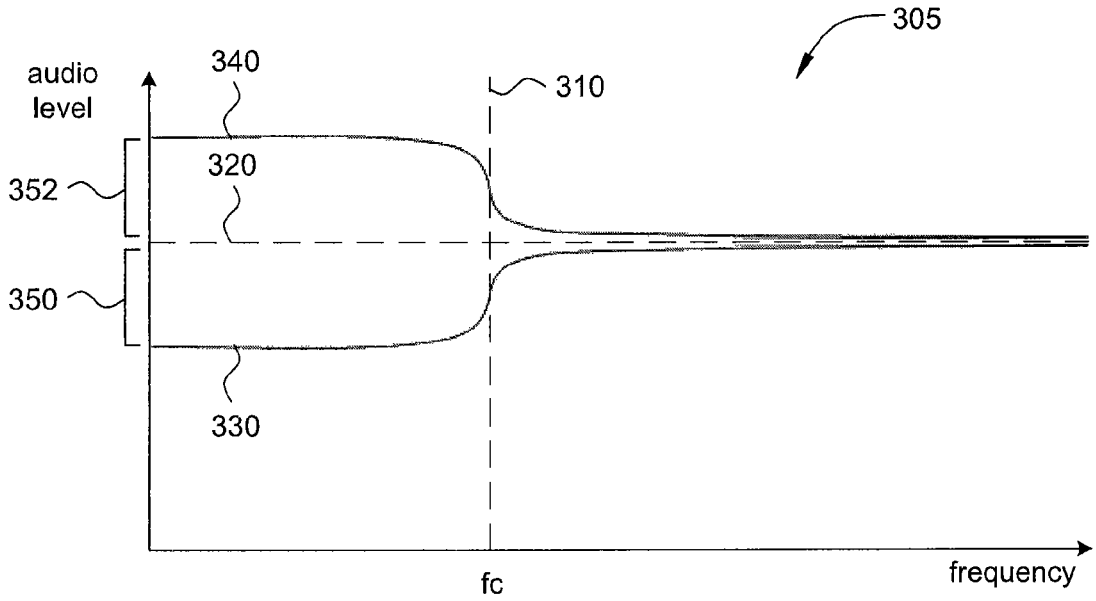

FIGS. 3A-3B are graphs 300 305 of waveforms associated with the first handheld device 210(0) and the second handheld device 210(1) of FIG. 2, according to one embodiment of the present invention.

As shown in FIG. 3A, the graph 300 includes a frequency response 310 of the first handheld device 210(0) and a frequency response 320 of the second handheld device 210(1). The frequency response 310 of the first handheld device 210(0) indicates a boost in the audio level above the critical frequency ($f_c$) 330. That is, the housing 230(0) acts as an infinite baffle for the micro-speakers 240(0) 250(0) in the first handheld device 210(0) for frequencies above $f_c$ 330. The difference 350 between the audio level below $f_c$ 330 and the audio level above $f_c$ 330 is typically 6 dB. The frequency response 320 of the second handheld device 210(1) indicates a flat frequency response in the frequency range illustrated in the graph 300. That is, the surface 220 acts as an infinite baffle for the micro-speakers 240(1) 250(1) in the second handheld device 210(1) across the entire frequency range depicted in the graph 300.

As shown in FIG. 3B, the graph 305 includes a frequency response 310 of the first handheld device 210(0), a frequency response 320 of the second handheld device 210(1), and a compensating function 340 applied by the DSP to the audio signal of the first handheld device 210(0). The frequency response 310 of the first handheld device 210(0) and the frequency response 320 of the second handheld device 210(1) function substantially the same as described in conjunction with FIG. 3A except as further described below.

If the audio DSP 115 within the first handheld device 210(0) detects that the first handheld device 210(0) is in free-space, and not sitting on a surface, then the audio DSP 115 applies a compensating function 340 to the audio signal before transmitting the audio signal to the micro-speakers. The compensating function 340 applies a boost to the audio signal at frequencies below $f_c$ 330 and applies no boost to the audio signal at frequencies above $f_c$ 330. The difference 352 between the boosted level below $f_c$ 330 and the non-boosted level above $f_c$ 330 is typically 6 dB, matching the difference 350 associated with the frequency response 310 of the first handheld device 210(0). The combined effect of the compensating function 340 and the frequency response 310 of the first handheld device 210(0) produces a flat frequency response that approximates the frequency response 320 of the second handheld device 210(1). As a result, the user perceives a flat frequency response whether the handheld device 210 is being held in free-space or placed on or near a surface.

Ported Enclosure Micro-Speaker Audio System

Figure 4A:
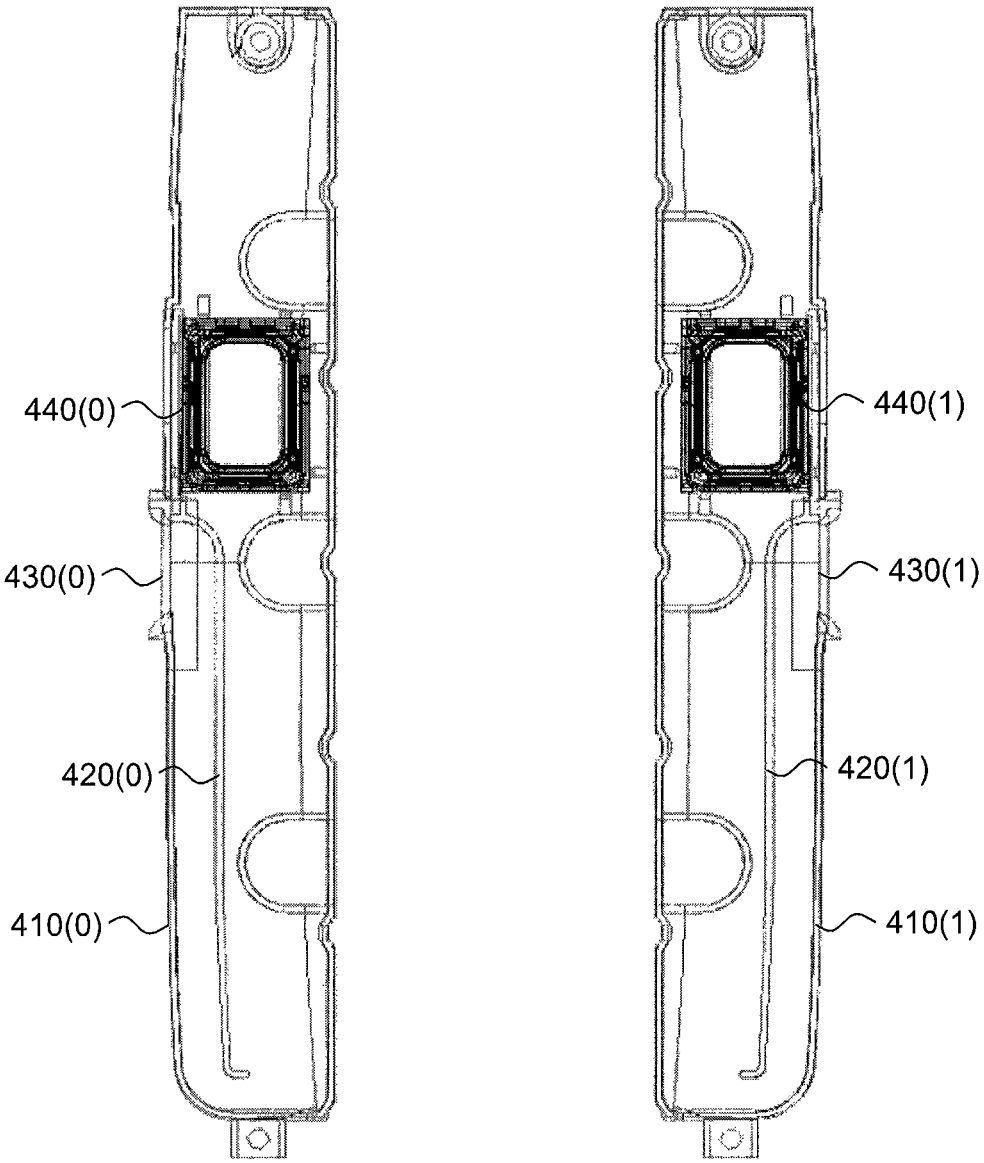
FIG. 4A illustrates ported enclosures for use in conjunction with the speaker in the computer system of FIG. 1, according to one embodiment of the present invention.

FIG. 4A illustrates ported enclosures 410 for use in conjunction with the speaker 117 in the computer system 100 of FIG. 1, according to one embodiment of the present invention. The ported enclosures may be implemented in conjunction with micro-speakers 440(0) 440(1) in various handheld devices, such as the left micro-speaker 240 and the right micro-speaker 250 in the handheld devices 210 illustrated in FIG. 2. As shown, the left ported enclosure 410(0) includes a corresponding port 420(0), and the right ported enclosure 410(1) also includes a corresponding port 420(1)

The left ported enclosure 410(0) houses the left micro-speaker 440(0) while the right ported enclosure 410(1) for the right micro-speaker 440(1). The left micro-speaker 440(0) and the right micro-speaker 440(1) are also shown in FIG. 4A. The ported enclosures 410 are configured to provide useful output from the out-of-phase rear-generated signals from the corresponding micro-speakers 440(0) 440(1). By altering the phase of such out-of-phase signals, the ported enclosures 410 prevent the contained out-of-phase signals from producing a cancelling effect on the in-phase forward generated signals from the corresponding micro-speakers 440(0) 440(1). Around the ported enclosure tuning frequency, the output from the speaker may be significantly reduced. As further described below, the ported enclosures 410 have a resonant frequency and characteristic response that enhance the response of the micro-speakers 440(0) 440(1). As a result, the micro-speakers 440(0) 440(1) may produce louder volume sounds at lower frequencies with reduced distortion relative to prior art implementations.

The ports 420, also known as vents, are openings within a speaker enclosure. The volume of air within the enclosure provides stiffness. The air mass within the port provides mass. The stiffness of the air within the enclosure combines with the mass of air within the port to form a mechanical resonance device referred to as a Helmholtz resonator. As further described herein, the mass of air within the port is a function of the length and cross sectional area of the port. The Q or quality factor of the ported enclosure resonance is inversely proportional to the port resistance. Increasing the port resistance decreases the output of the port which is typically undesirable. However, decreasing port output may be desirable in the following two circumstances:

a) In cases where the port output is excessive causing a peaking the response of the ported speaker above the enclosure tuning frequency. This effect is common in speakers which have high overall $Q_{ts}$ (that is, $Q_{ts}>0.4$), such as is typically the case for micro-speakers.

b) Below the ported enclosure tuning frequency where the speaker becomes unloaded resulting in excessive displacement and distortion.

Due at least in part to the above-described effect, micro-speakers are typically developed with sealed enclosures rather than ported enclosures. Designers of mobile devices and manufacturers of micro-speakers commonly believe that a ported enclosure is unusable in conjunction with a micro-speaker. This perception results from the fact that an overall speaker $Q_{ts}$ in the range of 0.3 to 0.5 is needed to achieve a maximally flat frequency response. Micro-speakers, however, commonly have a $Q_{ts}$ in the range of 1.0 to 1.5. Ported enclosures designed for use with such micro-speakers exhibit large frequency peaks and excursion peaks at frequencies above the port tuning frequency.

Figure 4B:
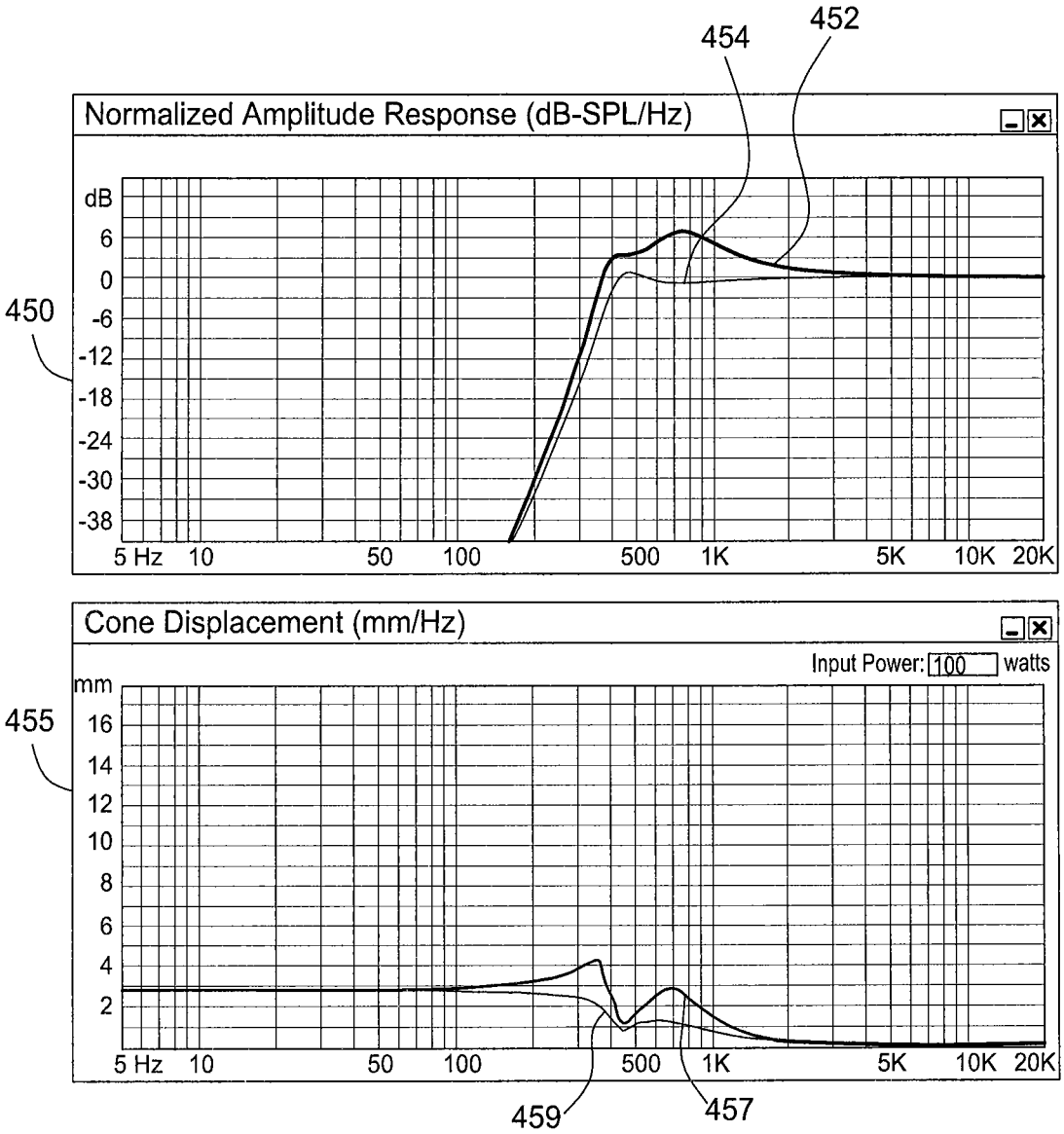
FIGS. 4B-4D illustrate normalized amplitude response and cone displacement of loudspeakers under various conditions, according to embodiments of the present invention.
Figure 4C:
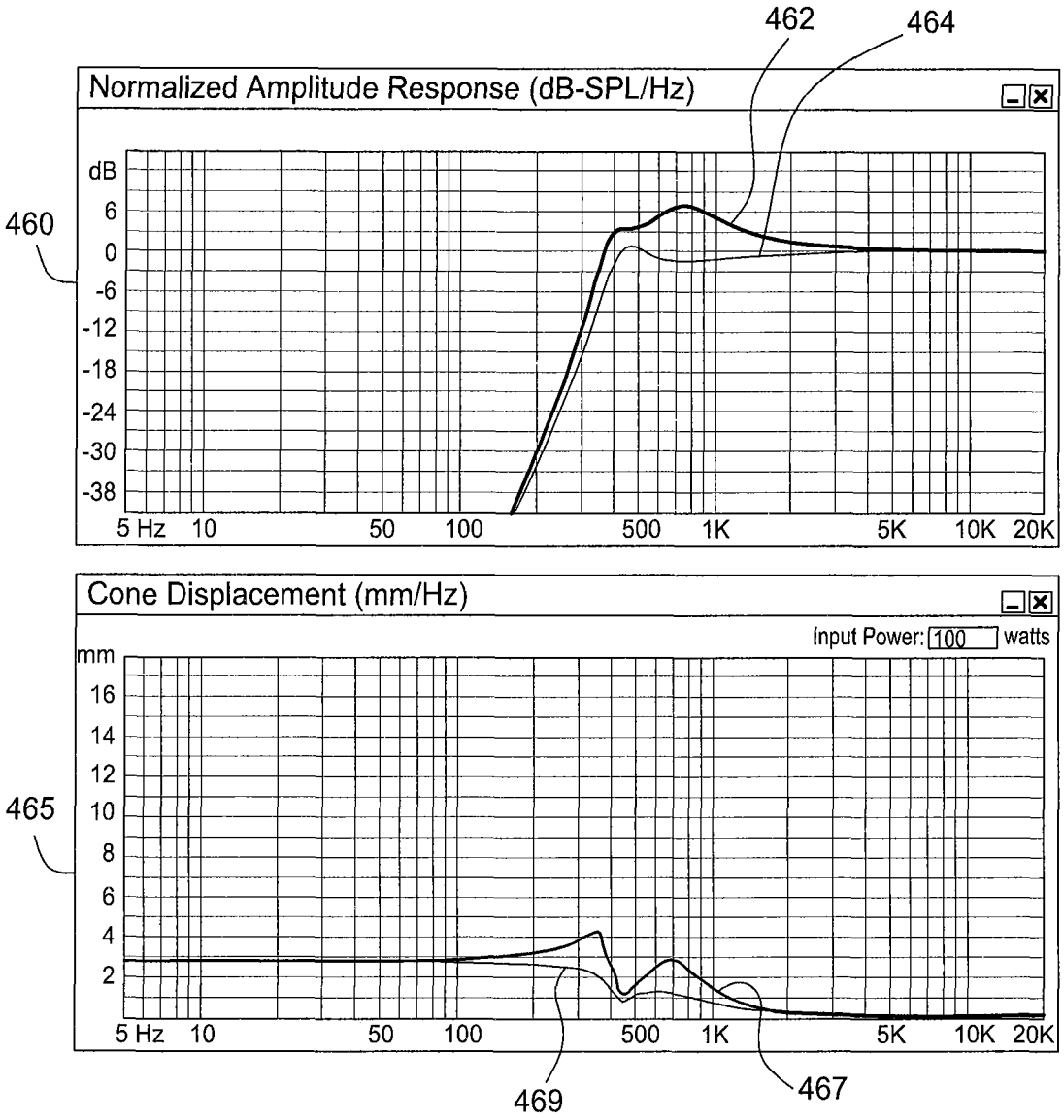
Figure 4D:
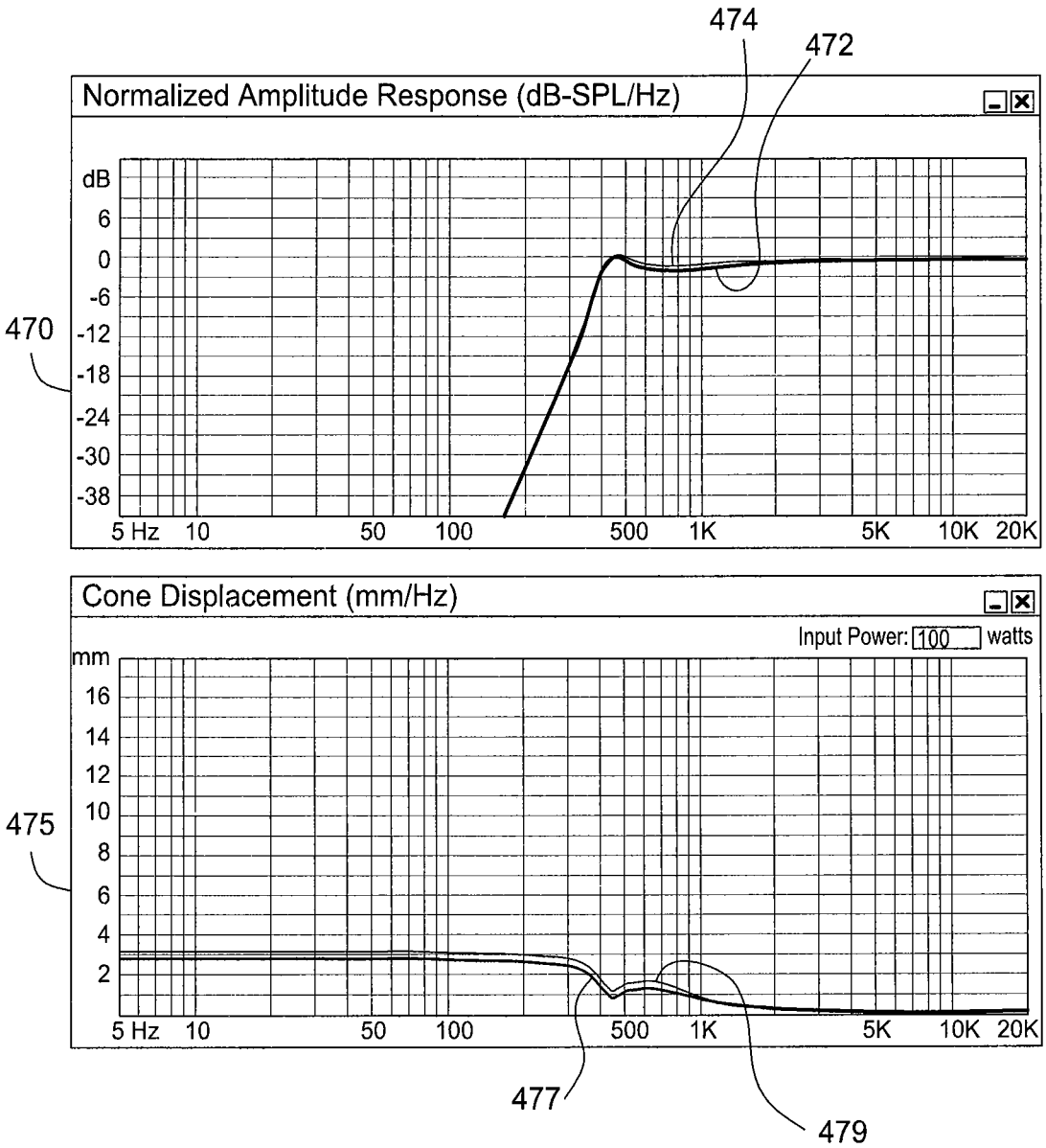

FIGS. 4B-4D illustrate normalized amplitude response and cone displacement of loudspeakers under various conditions, according to embodiments of the present invention.

As shown, FIG. 4B includes a graph illustrating normalized amplitude response 450 and a graph illustrating cone displacement 455.

The graph illustrating normalized amplitude response 450 includes two waveforms 452 454. Waveform 454 is indicative of the amplitude response exhibited by a loudspeaker with a $Q_{ts}$ of 0.5, which is typical of larger loudspeakers designed for home use. Waveform 454 exhibits slight peaking just below 500 Hz. Above this frequency, waveform 454 exhibits a relatively flat response. By contrast, waveform 452 is indicative of the amplitude response exhibited by a loudspeaker with a $Q_{ts}$ of 1.25, which is typical of micro-speakers in sealed enclosures, such as micro-speakers used for mobile devices. Waveform 452 also exhibits slight peaking just below 500 Hz. In addition, waveform 452 exhibits significant peaking starting just above 500 Hz until just below 5000 Hz. Above 5000 Hz, both waveform 452 and waveform 454 exhibit a relatively flat response. In general, waveform 454 illustrates a preferable frequency response, as compared with waveform 452.

The graph illustrating cone displacement 455 includes two waveforms 457 459. Waveform 459 is indicative of the speaker cone displacement exhibited by a loudspeaker with a $Q_{ts}$ of 0.5, which is typical of larger loudspeakers designed for home use. Waveform 459 exhibits decreasing cone displacement until just below 500 Hz. Above 500 Hz, cone displacement increases slightly until approximately 600 Hz. Above 600 Hz, cone displacement continually decreases as frequency increases. By contrast, waveform 457 is indicative of the amplitude response exhibited by a loudspeaker with a Qts of 1.25, which is typical of micro-speakers in sealed enclosures. Waveform 457 exhibits significant peaking both above and below 500 Hz, indicating relatively high cone displacement. Above approximately 1000 Hz, waveform 457 approaches waveform 459, indicating relatively low cone displacement. In general, waveform 459 illustrates a preferable cone displacement characteristic, as compared with waveform 457.

As shown, FIG. 4C includes a graph illustrating normalized amplitude response 460 and a graph illustrating cone displacement 465.

The graph illustrating normalized amplitude response 460 includes two waveforms 462 464. Waveform 462 is indicative of the amplitude response exhibited by a loudspeaker with a $Q_{ts}$ of 1.25, which is typical of micro-speakers in sealed enclosures. As such, waveform 462 is substantially the same as waveform 452 of FIG. 4B. Waveform 464 is indicative of the amplitude response exhibited by a loudspeaker with a $Q_{ts}$ of 1.25 in a ported enclosure with a relatively high port resistance. Waveform 464, corresponding to a micro-speaker in a ported enclosure, exhibits relatively less peaking above 500 Hz, as compared with waveform 462 corresponding to a micro-speaker in a sealed enclosure.

The graph illustrating cone displacement 465 includes two waveforms 467 469. Waveform 467 is indicative of the cone displacement exhibited by a loudspeaker with a Qts of 1.25, which is typical of micro-speakers in sealed enclosures. As such, waveform 467 is substantially the same as waveform 457 of FIG. 4B. Waveform 469 is indicative of the cone displacement exhibited by a loudspeaker with a $Q_{ts}$ of 1.25 in a ported enclosure with a relatively high port resistance. Waveform 469, corresponding to a micro-speaker in a ported enclosure, exhibits relatively lower cone displacement above 500 Hz, as compared with waveform 467 corresponding to a micro-speaker in a sealed enclosure.

As shown, FIG. 4D includes a graph illustrating normalized amplitude response 470 and a graph illustrating cone displacement 475.

The graph illustrating normalized amplitude response 470 includes two waveforms 472 474. Waveform 472 is indicative of the amplitude response exhibited by a loudspeaker with a $Q_{ts}$ of 0.5, which is typical of relatively large loudspeakers. As such, waveform 472 is substantially the same as waveform 454 of FIG. 4B. Waveform 474 is indicative of the amplitude response exhibited by a loudspeaker with a $Q_{ts}$ of 1.25 in a ported enclosure with relatively high port resistance. As such, waveform 474 is substantially the same as waveform 464 of FIG. 4C. As shown, the normalized amplitude response of a micro-speaker in a high-resistance ported enclosure, corresponding to waveform 474, is substantially the same as the normalized amplitude response of a loudspeaker with a $Q_{ts}$ of 0.5, corresponding to waveform 472.

The graph illustrating cone displacement 475 includes two waveforms 477 479. Waveform 477 is indicative of the cone displacement exhibited by a loudspeaker with a $Q_{ts}$ of 0.5, which is typical of relatively large loudspeakers. As such, waveform 477 is substantially the same as waveform 459 of FIG. 4B. Waveform 479 is indicative of the cone displacement exhibited by a loudspeaker with a $Q_{ts}$ of 1.25 in a ported enclosure with relatively high port resistance. As such, waveform 479 is substantially the same as waveform 469 of FIG. 4C. As shown, the normalized amplitude response of a micro-speaker in a high-resistance ported enclosure, corresponding to waveform 479, is substantially the same as the normalized amplitude response of a loudspeaker with a $Q_{ts}$ of 0.5, corresponding to waveform 477.

As illustrated in FIGS. 4B-4D, placing a micro-speaker in a ported enclosure with relatively high port resistance may result in improved normalized amplitude response and cone displacement, comparable to the normalized amplitude response and cone displacement more typically of larger loudspeakers.

In one embodiment, the ported enclosure 410 may have a volume of 15 $cm^3$ and may house a micro-speaker 440 with a volume of 1 $cm^3$. The resonance frequency of the micro-speaker 440 may be 270 Hz with low distortion. The relatively large volume of the ported enclosure 410 may provide sufficient room to include a port 420 has a diameter of 3 mm, or a radius of 1.5 mm, a length of 30 mm, and at least one flared end. The ported enclosure 410 may be tuned to a resonance frequency of 300 Hz. As such, the port 420 may extend the frequency response of the micro-speaker 440. The port may also reduce distortion at lower frequencies by reducing the needed volume displaced by the speaker at these lower frequencies. In addition, a front grill (not shown) on the case of the handheld device may be configured to include a left port output 430(0) and a right port output 430(1) for the left port 420(0) and right port 420(1), respectively.

Figure 5A:
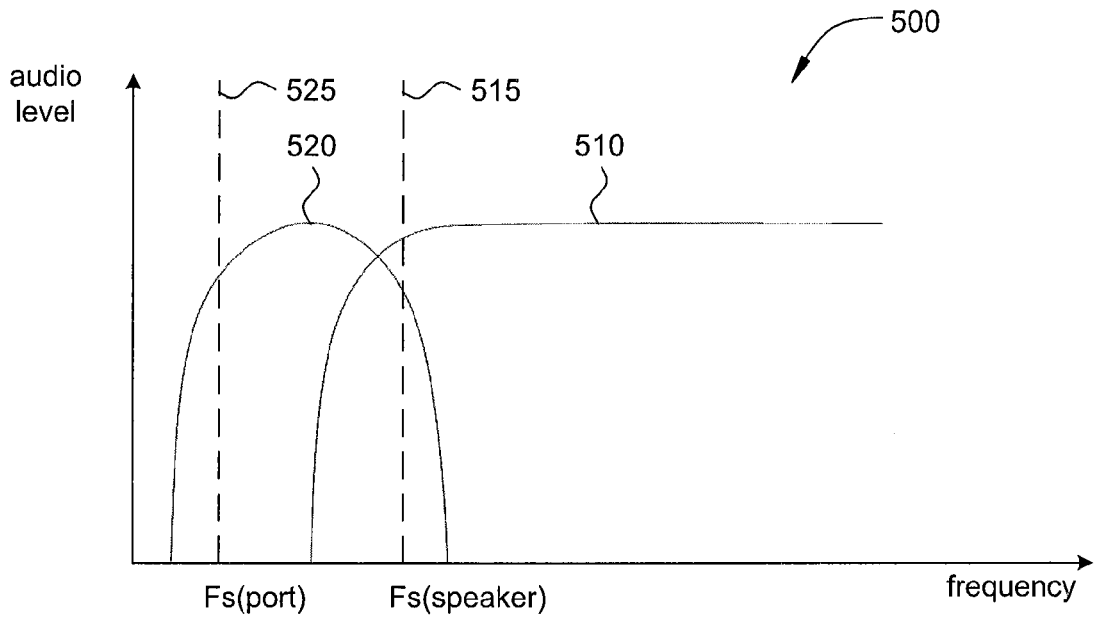
FIGS. 5A-5B are graphs of waveforms associated with the ported enclosures of FIG. 4A, according to one embodiment of the present invention.
Figure 5B:
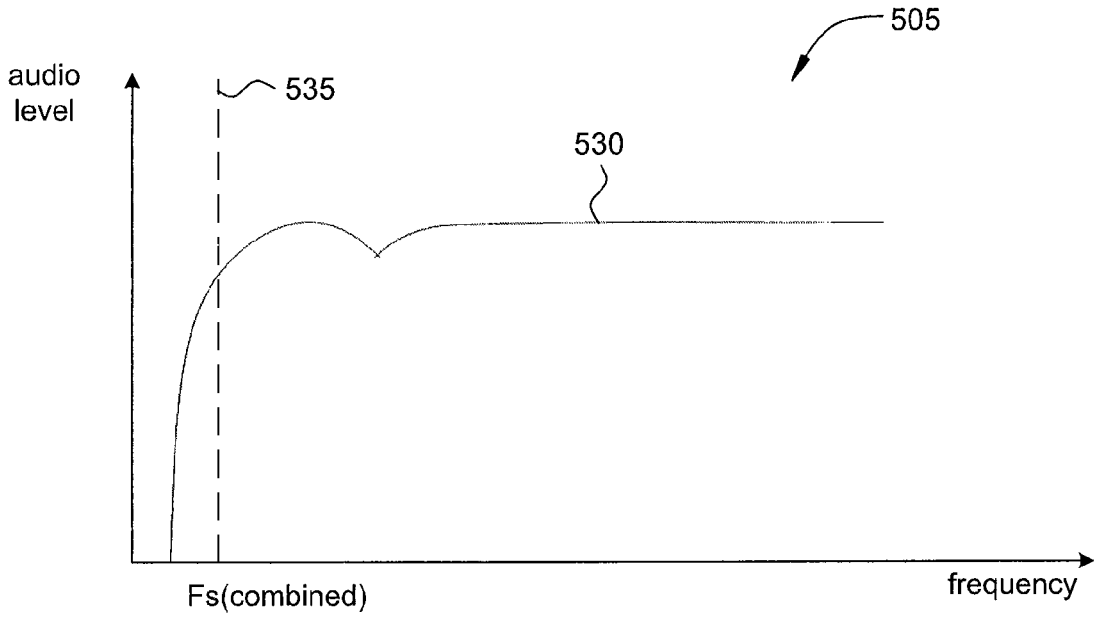

FIGS. 5A-5B are graphs 500 505 of waveforms associated with the ported enclosures of FIG. 4A, according to one embodiment of the present invention. As shown, graph 500 illustrates the micro-speaker response 510 and the port response 520. The micro-speaker response 510 includes a speaker resonance frequency $F_{s(speaker)}$ 515, while the port response 520 includes a port resonance frequency $F_{s(port)}$ 525.

Graph 505 illustrates the combined response 530 of the micro-speaker 240 250 and the port 420. The combined response 530 includes a combined resonance frequency $F_{s(combined)}$ 535.

The micro-speakers 240 250 are characterized by a set of Thiele-Small parameters. Such Thiele-Small parameters include the resonance frequency of the speaker ($F_s$), the compliance of the speaker driver ($C_{ms}$), the mechanical resistance of the speaker driver ($R_{ms}$), and the total Q of the speaker driver at the resonance frequency ($Q_{ts}$). The compliance of the speaker driver may be considered as the reciprocal of the stiffness of the speaker driver. The total Q is the combination of the electrical Q ($Q_{es}$) and the mechanical Q ($Q_{ms}$), which, in turn, are functions of $F_s$, $C_{ms}$, and $R_{ms}$. The Thiele-Small parameters model the speaker driver as a spring-mass system that resonates at $F_s$. Typically, the frequency response is relatively flat above $F_s$ and drops at a relatively steep rate below $F_s$.

Accordingly, the micro-speaker response 510 is relatively flat above $F_{s(speaker)}$, and rapidly falls off below $F_{s(speaker)}$. Generally, lower values of $F_{s(speaker)}$, are preferred to higher values of $F_{s(speaker)}$. That is, the lower the value of $F_{s(speaker)}$, the broader the micro-speaker response 510. The micro-speaker response 510 is bounded by physical constraints of the industrial and mechanical design which limit volume and port sizes as well as linear displacement limits. The limit of the large signal low frequency micro-speaker response 510 is limited by the volume of air that the micro-speaker 240 250 is able to displace at various frequencies. The relationship between frequency and volume displacement may be given by Equation 1 below:

$$\text{volume_displacement} \propto 1/\text{frequency}^2 \tag{1}$$

indicating that the volume displacement is inversely proportional to the square of the frequency. As a result, as the frequency produced by a speaker decreases, the amount of air that the speaker displaces to produce the frequency increases significantly. In general, speakers have two parameters associated with maximum displacement, that is, the maximum volume displaced by the speaker:

a. Maximum linear displacement, calculated as (coil length−magnetic gap length)/2 for overhung coils.
b. Absolute maximum displacement, defined as the displacement beyond which physical damage occurs to the speaker.

As a result, micro-speakers in sealed enclosures are typically designed with a critical frequency $F_{3(system)}$ below which the output of the micro-speaker diminishes at 12 db per octave. This design approach prevents excessive distortion at lower frequencies because the increase in displacement as frequency decrease is countered by the matching 12 db/octave frequency rolloff introduced by the sealed enclosure $F_{3(system)}$. For example, a typical micro-speaker with an enclosure volume of 1 $cm^3$, could have an $F_{3(system)}$ of approximately 800 Hz. The output of such a speaker decreases significantly at frequencies below 800 Hz. As a result, typical micro-speakers have relatively poor low-frequency response, as compared with larger loudspeakers. This effect results from the ability of larger loudspeakers to displace significantly larger volumes of air due to increased cone area and larger depth, as compared with micro-speakers. Accordingly, larger loudspeakers typically have significantly larger linear displacements as measured by (coil length−magnetic gap length)/2.

To counter this effect, a port 420 may be added to the enclosure that houses the micro-speaker 240 250. The port 420 may be tuned to have a resonance frequency $F_{s(port)}$ that is lower than $F_{s(speaker)}$. Accordingly, the port response 520 exhibits a curve that includes $F_{s(port)}$ 525, where $F_{s(port)}$ 525 is below $F_{s(speaker)}$ 515. The micro-speaker response 510 and the port response 520 combine to produce the combined response 535, where $F_{s(combined)}$ 535 is substantially the same frequency as $F_{s(port)}$ 525. The port 420 may be tuned by adjusting the dimensions and shape of the port 420 and the enclosure volume. The port 420 may be tuned to produce a port response 520 at different values of $F_{s(port)}$ 525. Tuning the port 420 to a higher $F_{s(port)}$ 525 reduces the bandwidth of the combined response 535 while improving the flatness of the combined response 530. Tuning the port 420 to a lower $F_{s(port)}$ 525 increases the bandwidth of the combined response 535 with the tradeoff that the combined response 530 is not as flat.

The small size of the micro-speakers 240 250 in the handheld device 210 presents a different set of issues and optimizations, as compared with larger speakers in enclosures.

As described above in conjunction with Equation 1, the displacement needed for a speaker driver to produce a particular frequency above the resonance frequency is proportional to the reciprocal of the square of the frequency. That is, the lower the frequency, the higher the volume displacement to produce that frequency.

At least two factors limit the maximum displacement for a given speaker. The first factor is a linearity limit that is generally calculated according to Equation 2 below:

$$\text{linearity_limit} = \frac{(\text{coil_length} - \text{gap_length})}{2} \tag{2}$$

The speaker produces distorted audio when driven above this linearity limit. The second factor is the mechanical limit above which the speaker will be damaged. Generally, neither limit should be exceeded. In addition, increasing the coil length may cause a decrease in efficiency because some sections of the coil may be outside of the magnetic gap and, accordingly, are not contributing to the force on the speaker driver.

Mobile devices present particular challenges for volume displacement. In general, the volume displaced by the speaker driver is a function of the cone area and linear displacement of the speaker coil. First, the cone area of the micro-speakers 240 250 is very small due to the small surface on which to mount the micro-speakers 240 250, rendering the micro-speakers 240 250 relatively inefficient. Second, the thickness of the speaker is also limited due to the thinness of the handheld device 210, limiting the coil length which, in turn, limits the maximum linear displacement of the micro-speakers 240 250. Because the cone area and maximum linear displacement are not easily increased, a ported enclosure 410 may be used to improve the large signal low frequency response without producing distortion or damaging the micro-speakers 240 250.

Figure 6:
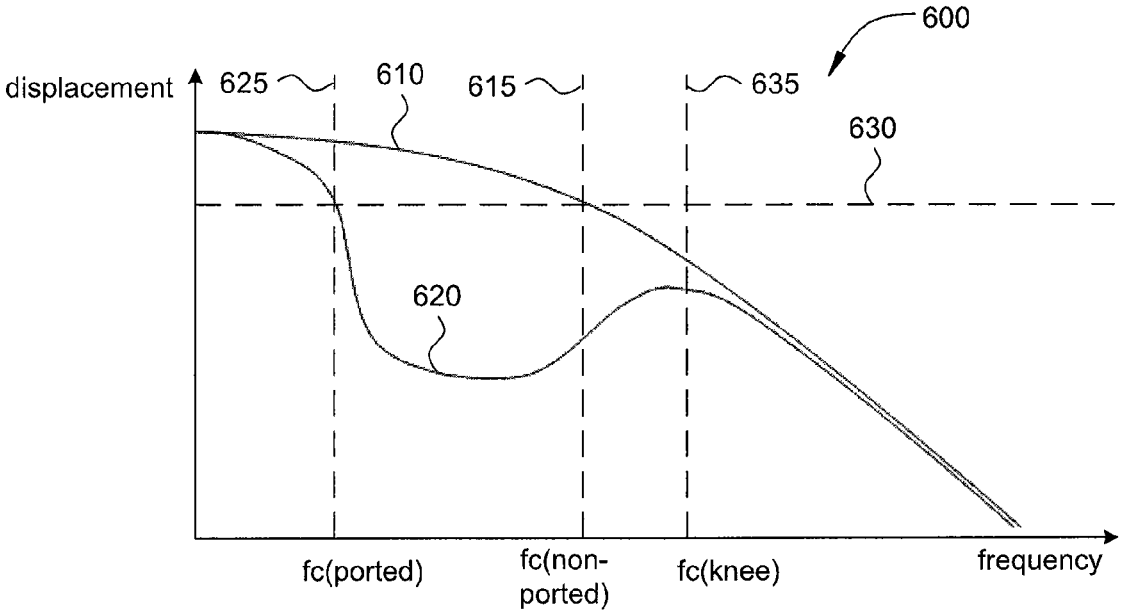
FIG. 6 is a graph of waveforms associated with the ported enclosures of FIG. 4A, according to another embodiment of the present invention.

FIG. 6 is a graph 600 of waveforms associated with the ported enclosures of FIG. 4A, according to another embodiment of the present invention. As shown, graph 600 illustrates the non-ported micro-speaker response 610 and the ported micro-speaker response 620.

The non-ported micro-speaker response 610 reaches a maximum displacement limit 630 at the non-ported critical frequency $F_{c(non\text{-}ported)}$ 615. Below $F_{c(non\text{-}ported)}$ 615, the non-ported response 610 exceeds the maximum displacement limit 630, based on the linearity limit or the damage limit of the micro-speakers 240 250. Placing the micro-speakers 240 250 in a ported enclosure 410 produces the ported response 620. The ported micro-speaker response 620 reaches a maximum displacement limit 630 at the ported critical frequency $F_{c(ported)}$ 625, where $F_{c(ported)}$ 625 is lower than $F_{c(non\text{-}ported)}$ 615. The port 420 may be tuned to increase or decrease $F_{c(ported)}$ 625. As $F_{c(ported)}$ 625 decreases, the bandwidth of the ported response 620 increases, but the non-linearity of the ported response 620 also increases. As $F_{c(ported)}$ 625 decreases, the displacement at the critical knee frequency $F_{c(knee)}$ 625 increases. Accordingly, the ported enclosure 420 may not be tuned to a $F_{c(ported)}$ 625 so low such that $F_{c(knee)}$ 625 increased above the maximum displacement limit 630.

In larger speaker systems, a ported enclosure may be used to extend the small signal low frequency response and to reduce the speaker driver displacement around the resonance frequency, resulting in larger displacement below the speaker resonance frequency. For larger enclosures, the ported enclosure is tuned to achieve a maximum extension of the small signal low frequency response, while having a maximally flat ported frequency response 620. The reduced displacement of the speaker cone is a by-product of these optimizations.

In micro-speaker systems, however, the ported response 620 is limited more by displacement limits than by the flatness of the ported response 620. Because of the low displacement efficiency inherent in the micro-speakers 240 250 of the handheld device 210, the purpose of using a ported enclosure 410 with micro-speakers 240 250 is to limit volume displacement. Typically, the limitations of the micro-speakers 240 250 produce a ported response 620 that is significantly non-linear, as shown. Such a non-linear ported response 620 may be objectionable to the listener. However, such non-linearity in the ported response 620 may be corrected using parametric equalizers within the audio DSP 115. These parametric equalizers may be used to provide the steep high pass filters required for reducing the displacement of bass reflex enclosures below the port tuning frequency and to compensate for the non-linearity of the ported response 620. Accordingly, the ported enclosure 410 is typically designed to consume the available space within the handheld device 210, irrespective of non-linearity that may be produced in the ported response 620. If the resulting ported response is not sufficiently flat, then the audio DSP 115 may apply an equalizer to the audio signal to produce a flat response.

The ported enclosure 410 may be tuned to a resonance frequency $F_s$ to produce the desired ported response 620. The resonance frequency $F_s$ of the ported enclosure 410 is a function of enclosure volume, affecting compliance or inverse stiffness, and the mass of air in the port 420. Typically, applications designed to simulate ported enclosures assume that the mass of air in the vent is given by Equation 3 below:

$$M_p = \text{air_density} \times \frac{L_p}{\pi \times R_p^2} \tag{3}$$

where $L_p$ is the port length and $R_p$ is the port radius.

Within the physical constraints of the handheld device 210, the port length and the port radius may be adjusted to get the desired port mass or port resonance frequency. For example, a larger port radius could be used with a longer port length. Alternatively, a shorter vent length could be used with a smaller vent radius. An additional practical limit may be placed port radius such that the port is not so small as to produce audible vent air flow noise.

For ported enclosures 410 used with micro-speakers 240 250, changing the port radius also affects the vent resistance $R_v$, as given in Equation 4 below:

$$R_v = R_s + R_r \tag{4}$$

where $R_s$ is the resistance due to air velocity in the vent, and $R_r$ is the radiation resistance of the port. Note that $R_s$ is proportional to $$\frac{L_p}{R_p^3}.$$

For example, holding enclosure volume and the box resonant frequency constant, if the port radius is decreased by two, then the port length could be decreased by four. However, ignoring the fixed port radiation resistance, the vent resistance would go up by 2. As shown, the additional degree of freedom of the port radius could be used to adjust the vent resistance. Although increasing vent resistance may reduce the port output, increasing vent resistance may also decrease the speaker driver cone displacement, particularly at frequency below the resonance frequency of the enclosure.

It will be appreciated that the architecture described herein is illustrative only and that variations and modifications are possible. In one example, the techniques described herein could be used in association with handheld devices 210 with a left micro-speaker 240 and a right micro-speaker 250. However, the described techniques may be used with any technically feasible quantity of speakers, including, with limitation, a single speaker, and more than two speakers. In another example, the techniques described herein could be used in association with handheld devices 210 that include a ported enclosure 410. However, the described techniques may be used with a passive radiator with similar results, where a passive radiator typically has the same or similar structure as the main speaker, but without a voice coil or magnet assembly. Sound wave pressure from the main speaker moves the cone on the passive radiator. The passive radiator is a non-active speaker cone that may have a mechanism to tune the passive radiator to a particular resonance frequency.

In another example, a given handheld device could include a frequency response adjustment mechanism only, a ported micro-speaker enclosure only, or both a frequency response adjustment mechanism and a ported micro-speaker enclosure. A handheld device with a frequency response adjustment mechanism and a sealed micro-speaker enclosure would automatically compensate the frequency response of the audio system by based on whether the device is being held or placed on a surface, but would not exhibit an extended bass response associated with a ported enclosure. A handheld device with a ported micro-speaker enclosure but without a frequency response adjustment mechanism would have an extended bass response, as compared with a sealed enclosure, but would not adjust the frequency response based on the device being held or placed on a surface. A handheld device with both a frequency response adjustment mechanism and a ported micro-speaker enclosure would have an extended bass response and would adjust the frequency response based on the device being held or placed on a surface.

Figure 7:
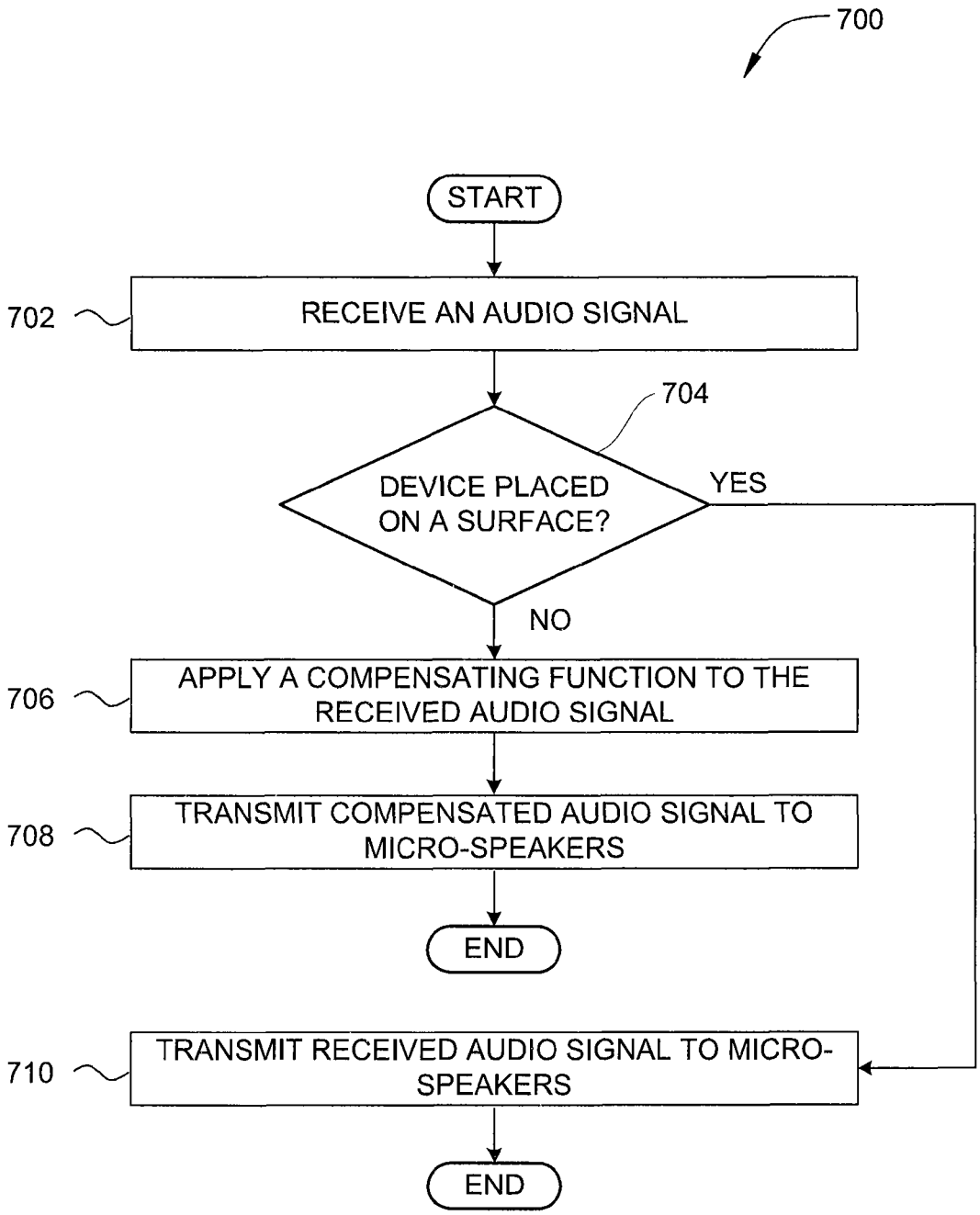
FIG. 7 sets forth a flow diagram of method steps for processing audio signals in a handheld device, according to one embodiment of the present invention, according to one embodiment of the present invention.

FIG. 7 sets forth a flow diagram of method steps for processing audio signals in a handheld device, according to one embodiment of the present invention. Although the method steps are described in conjunction with the systems of FIGS. 1, 2, and 4, persons of ordinary skill in the art will understand that any system configured to perform the method steps, in any order, is within the scope of the inventions.

As shown, a method 700 begins at step 702, where the audio DSP 115 receives an audio signal. The audio signal may be received from any technically feasible source, including, without limitation, a software application, device driver, or an operating system. At step 704, the audio DSP 115 determines whether the handheld device 210 has been placed on or near a surface, as previously described herein. The audio DSP 115 may use any technically feasible means to determine whether the handheld device 210 has been placed on or near a surface, as described herein. If the handheld device 210 is not placed near a surface, then the method 700 proceeds to step 706, where the audio DSP 115 applies a compensating function 340 to the received audio signal. At step 708, the DSP 115 transmits the compensated audio signal to the micro-speakers 240 250. The method 700 then terminates.

Returning to step 702, if the handheld device 210 has been placed on or near a surface, then the method 700 proceeds to step 710, where the audio DSP 115 transmits the received audio signal to the micro-speakers 240 250. The method 700 then terminates.

In sum, a handheld device includes detection logic configured to determine whether a handheld device is being held by a user in free-space or placed on or near a large surface, such as a table. If the handheld device is being held by a user in free-space, then a digital signal processor (DSP) applies a compensating function to the audio signal before sending the audio signal to the micro-speaker driver in the handheld device. For example, the DSP could apply a compensating function that boosts the audio signal below a critical frequency by 6 dB. If the handheld device has been placed on or near a surface, then a digital signal processor (DSP) does not apply the compensating function to the audio signal before sending the audio signal to the micro-speaker. A ported enclosure reduces volume displacement a low frequencies. The port length, port radius, and vent resistance to produce a desired ported response with a lower critical frequency. The DSP may correct any resulting non-linearity in the ported response by applying an equalizer function to the audio signal before transmitting the audio signal to the micro-speakers.

One advantage of the disclosed techniques is that a flat frequency response is produced by the handheld device whether the handheld device is being held in free-space or placed on a table. The perceived sound quality does not change regardless of whether the mobile device is hand held or placed on a table. Another advantage of the disclosed techniques is that micro-speakers in the handheld device produce relatively high volume signals at low frequencies with little or no distortion. As a result, the user of the handheld device experiences an improved audio experience across a variety of applications.

The invention has been described above with reference to specific embodiments. Persons of ordinary skill in the art, however, will understand that various modifications and changes may be made thereto without departing from the broader spirit and scope of the invention as set forth in the appended claims. The foregoing description and drawings are, accordingly, to be regarded in an illustrative rather than a restrictive sense.

Therefore, the scope of embodiments of the present invention is set forth in the claims that follow.

What is claimed is:

1. A ported enclosure configured to house a micro-speaker, comprising:

an enclosure comprising a port, wherein the enclosure is tuned to a first resonance frequency that is different from a second resonance frequency associated with the micro-speaker;

wherein the micro-speaker has a Qts that exceeds 0.5.

2. The ported enclosure of claim 1, wherein the first resonance frequency is based on at least one of a linear dimension associated with the port and a cross sectional area associated with the port.

3. The ported enclosure of claim 1, wherein the port comprises a circular cross-section and the first resonance frequency is based on at least one of a linear dimension associated with the port and a radius associated with the port.

4. The ported enclosure of claim 1, wherein a Q value of the first resonance frequency and a combined response of the micro-speaker and the port are based on a first resistance associated with the port.

5. The ported enclosure of claim 4, wherein the first resistance is inversely proportional to a cross sectional area associated with the port.

6. The ported enclosure of claim 5, wherein the cross sectional area associated with the port corresponds to a value for the first resistance that reduces at least one of audio distortion and cone displacement related to the micro-speaker at frequencies above the first resonance frequency.

7. The ported enclosure of claim 5, wherein the cross sectional area associated with the port corresponds to a value for the first resistance that reduces at least one of amplitude peaking, audio distortion, and cone displacement related to the micro-speaker at frequencies below the first resonance frequency.

8. The ported enclosure of claim 4 wherein the port comprises a circular cross-section and the first resistance is proportional to a square of the radius associated with the port.

9. The ported enclosure of claim 1, wherein the port has a length of approximately 30 mm and a radius of approximately 1.5 mm.

10. The ported enclosure of claim 1, wherein the port has a first end and a second end, and at least one of the first end and the second end is flared.

11. The ported enclosure of claim 1, wherein the first resonance frequency is approximately 300 Hz, and the second resonance frequency is approximately 270 Hz.

12. A speaker module, comprising:

a micro-speaker associated with a handheld device, wherein the micro-speaker has a Qts that exceeds 0.5; and a ported enclosure configured to house the micro-speaker.

13. The speaker module of claim 12, wherein the ported enclosure comprises a port tuned to a first resonance frequency that is different from a second resonance frequency associated with the micro-speaker.

14. The speaker module of claim 13, wherein the first resonance frequency is based on at least one of a linear dimension associated with a port and a cross sectional area associated with the port.

15. The speaker module of claim 13, wherein the port comprises a circular cross-section and the first resonance frequency is based on at least one of a linear dimension associated with the port and a radius associated with the port.

16. The speaker module of claim 13, wherein a Q value of the first resonance frequency and a combined response of the micro-speaker and the port are based on a first resistance associated with the port.

17. The speaker module of claim 16, wherein the first resistance is inversely proportional to a cross sectional area associated with the port.

18. The speaker module of claim 17, wherein the cross sectional area associated with the port corresponds to a value for the first resistance that reduces at least one of amplitude peaking, audio distortion, and cone displacement related to the micro-speaker at frequencies below the first resonance frequency.

19. The speaker module of claim 17, wherein the port comprises a circular cross-section and the first resistance is proportional to a square of the radius associated with the port.

20. A handheld device, comprising:

a processor; and a speaker module comprising:

a micro-speaker;

a passive resonator; and an enclosure configured to house the micro-speaker.

* * * * *